US006185835B1

(12) United States Patent
Enbom et al.

(10) Patent No.: US 6,185,835 B1
(45) Date of Patent: Feb. 13, 2001

(54) APPARATUS FOR CONDITIONING OF COMMODITIES FOR VACUUM PACKING

(75) Inventors: Sven Äke Enbom, Quezon City (PH); Alex Tin Sing Lee, Tuen Mun (HK); John Anderson Mitchell, Sevenoaks (GB)

(73) Assignee: Qualpak UK Limited, Essex (GB)

( * ) Notice: Under 35 U.S.C. 154(b), the term of this patent shall be extended for 0 days.

(21) Appl. No.: 09/380,387

(22) PCT Filed: Mar. 2, 1998

(86) PCT No.: PCT/GB98/00636

§ 371 Date: Jan. 26, 2000

§ 102(e) Date: Jan. 26, 2000

(87) PCT Pub. No.: WO98/38372

PCT Pub. Date: Sep. 3, 1998

(30) Foreign Application Priority Data

Feb. 28, 1997 (GB) ..... 9704251

(51) Int. Cl.[7] ..... F26B 25/00

(52) U.S. Cl. ..... 34/105; 34/211; 34/212; 34/225; 34/233

(58) Field of Search ..... 34/64, 72, 76, 34/78, 86, 105, 106, 666, 210, 211, 212, 225, 233; 62/309, 310, 314

(56) References Cited

U.S. PATENT DOCUMENTS

| | | | | |
|---|---|---|---|---|
| 3,257,739 | | 6/1966 | Wentz | 34/31 |
| 4,432,147 | * | 2/1984 | Chen et al. | 34/77 X |
| 4,530,165 | * | 7/1985 | Tiedmann | 34/212 X |
| 5,119,571 | * | 6/1992 | Beasly | 34/86 X |
| 5,271,164 | * | 12/1993 | Yoshimura et al. | 34/105 |
| 5,343,632 | * | 9/1994 | Dinh | 34/86 X |
| 5,568,692 | * | 10/1996 | Crompton et al. | 34/666 X |
| 5,725,664 | * | 3/1998 | Nanbu et al. | 118/52 |
| 5,926,970 | * | 7/1999 | Zonco et al. | 34/211 X |

FOREIGN PATENT DOCUMENTS

| | | | |
|---|---|---|---|
| 29 15 443 A1 | 10/1980 | (DE) | D06F/73/00 |
| 37 27 570 A1 | 3/1989 | (DE) | D06B/19/00 |
| 100 686 A2 | 2/1984 | (EP) | B65B/31/00 |
| 1 597 242 | 9/1981 | (GB) | B65B/31/02 |
| WO 88/09839 | 12/1988 | (WO) | D06F/73/02 |

* cited by examiner

*Primary Examiner*—Stephen Gravini
(74) *Attorney, Agent, or Firm*—Darby & Darby

(57) ABSTRACT

Apparatus is provided for the conditioning of a commodity (12) such as clothing suitable for vacuum packing in which there is provided a conditioning tunnel (2) including a floor (4), a ceiling (6) and two side walls (8), through which tunnel runs a conveyor system (10) for transporting the commodity. The tunnel is provided with air inlets (14) for directing streams of air into tunnel, and means for extracting and transporting air from the tunnel to apparatus for dehumidifying the air. There is further provided means for conveying the dehumidified air to the air inlets. Means are provided on at least one side wall for influencing the flow path of the air passing from the inlet to the outlet. Use of the apparatus conditions the commodity so that when vacuum packed, the commodity does not crease.

18 Claims, 1 Drawing Sheet

FIG. 1
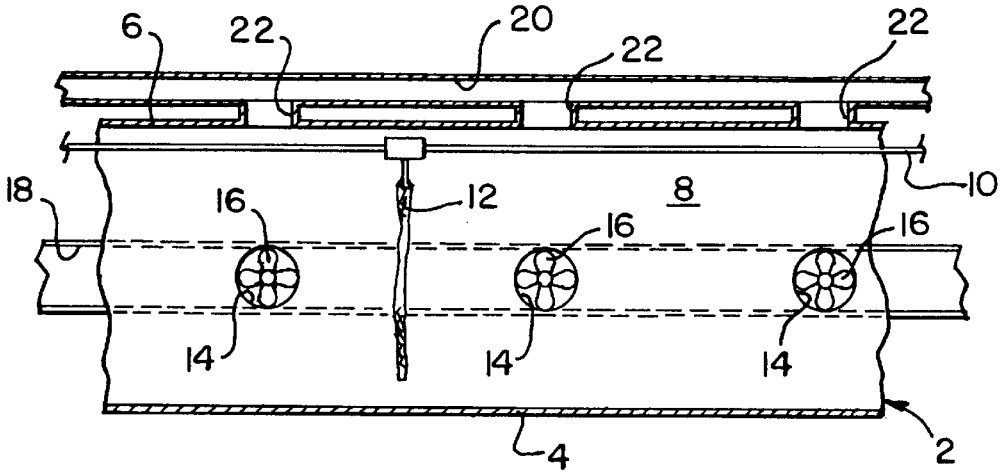
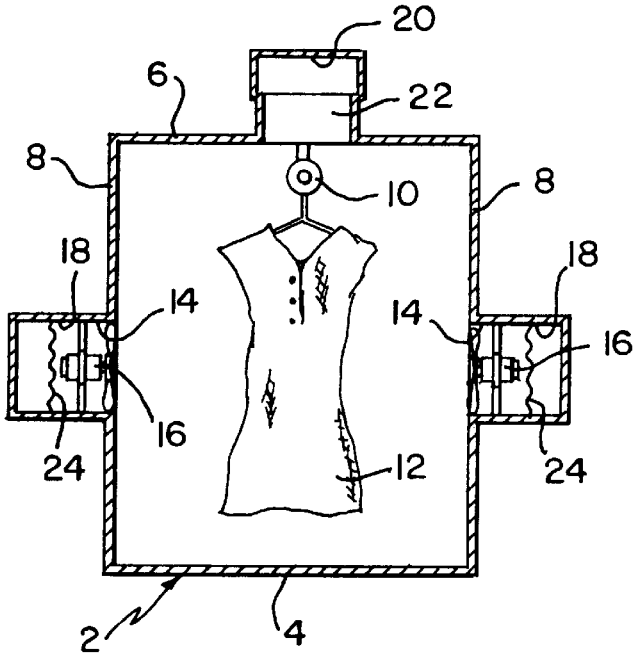
FIG. 2
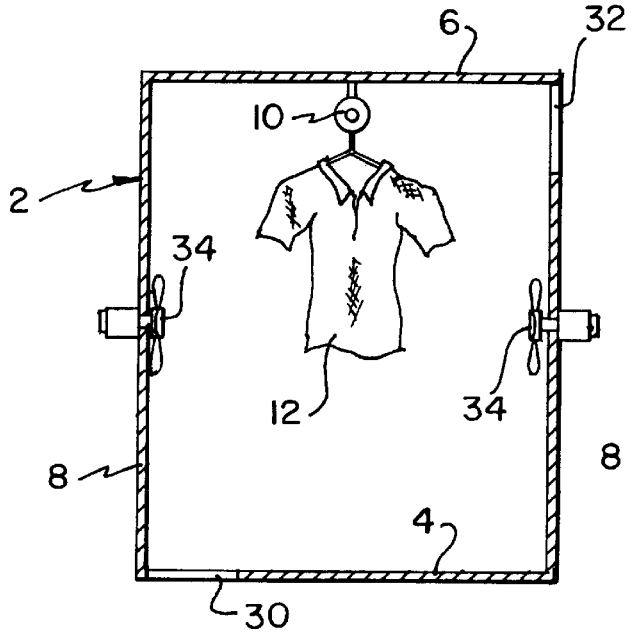
FIG. 3

APPARATUS FOR CONDITIONING OF COMMODITIES FOR VACUUM PACKING

This invention relates to the packaging of commodities and in particular to the packaging of such items for transportation prior to sale of the items to wholesalers or the ultimate end users.

It is well known that in modern trade the place of manufacture of an item and the place of sale of such an item either to a wholesaler or to an end user may be geographically far apart. This is particularly so in the case of the manufacture of clothing, cushions, bedding, towels and like products which are either wholly or partially constructed of fabric, and which may include foam or other readily compressible materials. Such items may conveniently be referred to as commodities.

When selling a commodity that is manufactured a long way from its point of sale, for instance much clothing is made in the Far East and sold in Europe, a significant portion of the expense involved in the sale of such clothing is a result of transportation costs. Such costs include the cost of physically moving the articles of clothing from their point of manufacture to the point of sale, and the cost of placing the clothing in a fit state for sale once the clothing has reached the point of sale.

It is current practice to transport a commodity such as clothing in shipping containers. The cost of transporting a shipping container is dependent upon the size of the container rather than its weight. Thus the greater the density of packing of the container the lower the cost of transporting the clothing per unit clothing transported. However, it is well known that for many commodities which are wholly or partially made of fabric the more densely packed a transportation container is the greater the time and effort that will be needed once the commodity has reached its point of sale, to place that commodity in a fit condition for sale. Such effort may include activities such as hanging in unrestricted space for a period of time, ironing, pressing or other treatments in case of clothing. Clearly such activities may offset any savings made as a result of densely packing the shipping container.

Various methods of preparing commodities for transportation so as to maximise the density of items transported but minimise the cost of placing the items in saleable condition have been suggested.

One such suggestion is to vacuum pack the commodity, thus reducing its bulk before transportation, and removing the commodity from the vacuum packing either before sale, or, in some instances, allowing the purchaser to remove it from the packaging. Vacuum packing the commodity and the compression that occurs during vacuum packing can leave the commodity very creased if no conditioning of the fabric of the commodity occurs before the vacuum packing.

A known method of conditioning of the fabric prior to vacuum packing consists of adjusting the fabrics' relative humidity and temperature to predetermined levels. Such techniques are known and British patent GB 1597243 discusses the relationship of humidity, temperature and creasing in greater detail.

Apparatus used to condition the fabric according to this method is known and disclosed in British patent GB 1597242. In GB 1597242 there is disclosed a conditioning tunnel through which clothing or some other commodity to be conditioned passes on a conveyor mechanism whilst hanging on appropriate hangers. From the floor of the tunnel air conditioned to a predetermined temperature and humidity is forced from a main air supply into the tunnel toward the clothing, and flows out of outlet vents situated at the top of each side wall of the tunnel. The air exiting the tunnel through the vents travels through an air treatment device to be reconditioned with respect to temperature and humidity and is then placed back into the main air supply system to be forced once more into the tunnel. GB 1597242 discloses that it is desirable to have the air forced towards the clothing conditioned to have a first conditioning temperature and humidity for the first conditioning portion of the tunnel and a second stabilising temperature and humidity in the second stabilising portion of the tunnel.

The apparatus as disclosed in GB 1597242 has been found in practice to have disadvantages. Firstly, it has been found that if a batch of garments, that is the garments are next to each other and lightly touching, is to be conditioned the air blown at the garments does not fully penetrate the garments, and at the end of conditioning the temperature and relative humidity of the fabric forming the garments varies according to where the sample of fabric tested is within the garment as a whole, and where in the batch the particular item of clothing is located. Clearly if the fabric of each garment is not properly conditioned throughout each garment the vacuum packing of the batch of garments may well result in garments that when unpacked are partially in satisfactory condition and partially require attention to bring the garments into saleable condition. This is undesirable.

The above mentioned problems with the apparatus disclosed in GB 1597242 are overcome by that apparatus if the batch of garments remains in the apparatus for sufficient time, i.e. several hours or days. If this approach to overcoming the problems is adopted however, the economies resulting from the packaging of the garments as described are offset by the costs arising from the low throughput of garments through the apparatus. Thus simply increasing the time the garments remain in the apparatus is not a satisfactory solution to the above problem of the apparatus.

A second problem with the apparatus disclosed in 1597242 is that the apparatus is only provided with one air treatment device 52. This results in the air passing through the air treatment device, which is used throughout the conditioning process of the garments being of a single temperature and humidity. This means that it is very difficult to vary the temperature of the conditioning air through the conditioning portion for stabilising should such variance be desired. With modern synthetic fabrics it has been found that such variance is very important to successful conditioning.

According to the present invention there is provided apparatus for the conditioning of a commodity suitable for vacuum packing in which there is provided a conditioning tunnel including a floor, a ceiling, and first and second side walls, through which tunnel runs a conveyor system for transporting the commodity, air inlets for directing streams of air into the tunnel, air outlet means through which air may be extracted, means for conveying air from the outlet means to apparatus for dehumidifying the air, and means for conveying the dehumidified air to the air inlets, in which at least one of the side walls of the tunnel is provided with at least one means for influencing the flow path of the air passing from the inlet to the outlet. The advantage of this configuration is that the means for influencing the flow path of the air (or causing turbulence in the air in the tunnel) causes the air stream between the inlet and outlet to cease to be a smooth air stream that may well simply flow around the commodity, to an air stream that is turbulent and which accordingly buffets the commodity from a multitude of different directions. This multi-directional buffeting of the commodity causes the dehumidified air to penetrate a batch of garments to a much greater degree than a smooth flow of air, and accordingly results in a much evener and complete conditioning of the commodity than is achieved by the prior art.

In one preferred embodiment the air inlet means pass through both side walls of the tunnel, one or more of the air inlet means is provided with an air temperature regulation means to regulate the temperature of the input air, and the air extraction means are located in the ceiling of the tunnel.

In this preferred embodiment the means for influencing the flow path for the air passing from the inlet to the outlet is located in the mouth of the air inlet means.

Alternatively, the present invention provides apparatus for the conditioning of a commodity suitable for vacuum packing in which there is provided a conditioning tunnel including a floor, a ceiling, and two side walls, through which tunnel runs a conveyor system for transporting the commodity, air inlets for directing streams of air at the commodities being conveyed through the tunnel, means for extracting and transporting air from the tunnel to apparatus for dehumidifying the air, and means for conveying the dehumidified air to the air inlets, in which the air inlets pass through both side walls of the tunnel, one or more of the air inlet means is provided with an air temperature regulation means to regulate the temperature of the input air, and the air extraction means are located in the ceiling of the tunnel.

In this embodiment, the apparatus of the present invention has the benefit that the air directed toward the commodity being conditioned is directed at the commodity from both sides. This results in greatly improved air penetration into a batch of articles of the commodity being treated and leads to an even and complete conditioning of the commodity. The improved air penetration is again attributable to the method of introduction of air into the tunnel and causing turbulent flow in the air.

The air inlets may all be at the same height in the tunnel walls, or they may be of different heights.

In a particularly preferred embodiment the air inlet means are located in the same longitudinal positions along the tunnel in each wall. Each of the opposing pairs of air inlet means may either be located at the same height in the side walls as each other, or they may be located at different heights on each wall.

In one embodiment of the present invention there may be a plurality of air inlets in one or both side walls at a single longitudinal position in the tunnel.

The temperature of the air stream directed at the commodity may be varied from air inlet to air inlet by means of the air temperature regulation means at the individual air inlets. The air temperature regulation means may be electrical resistance heaters, heat exchangers or any other preferred means. The air temperature regulation means may be used for heating or cooling the air, and the type of temperature regulation means chosen will depend upon whether it is expected that the air will need to be heated, cooled, both, or neither.

The temperature of the air leaving each air inlet may be different so that a batch of commodities may have air of varying temperature directed at the batch either along the length of the tunnel, or over the whole surface area of the batch of commodities at a particular longitudinal position in the tunnel. This latter option proves especially desirable in mixed fabric commodities where optimum conditioning conditions vary between the fabrics.

The air streams directed upon the commodities may either be created by individual fans at each air inlet, or may be created by a single air impelling means such as a fan located in a conduit connecting the dehumidifying apparatus and the air inlets.

Each of the air inlets may optionally also be provided with a means for directing the flow of air passing out of the inlet. The air direction means may be, for example, in the form of a variably pitched louvre. That is plurality of substantially parallel slats, each of which slats may rotate about its major axis, and which slats are all connected to each other so as to maintain the slat's parallel relationship to each other. If the slats are orientated so that their major axis is substantially parallel to the ceiling of the tunnel, or the conveyor, rotating the slats about their major axis will allow the air exiting the air inlet to be directed into whatever part of the tunnel is appropriate. This has the advantage that optimum conditioning of the commodities may be achieved irrespective of the size of the commodity to be conditioned by the specific direction of the air at the commodities.

The floor of the tunnel may be formed from the floor of the location in which the apparatus is placed. Alternatively it may be raised above the floor of the location in which the apparatus is placed. This will allow the placing of items such as ducting for the conditioning air to run under the tunnel floor from the dehumidifying apparatus to the air inlets. In a further alternative the flooring can be wholly or partially comprised of the top wall of an air duct. This alternative allows conditioning air to be introduced into the duct forming the floor of the tunnel from the dehumidifying apparatus, and extracted into the side walls of the tunnel at whatever position along the side walls it is desired.

The side walls of the tunnel may be constructed in such a fashion that ducting supplying air to the air inlets is included in the walls or attached to the walls either inside or outside of the tunnel. Alternatively the side walls may comprise of a pair of side skins joined by top and bottom skins at the top and bottom of the walls respectively and the void between the skins forms a duct through which the conditioning air from the dehumidifier flows. In this alternative air inlets can be cut into a side skin of the wall so as to introduce air into the tunnel at whatever position desired.

In an alternative embodiment of the present invention, the air inlet means pass through the floor of the tunnel. Such inlet means can either be a number of discrete apertures each of which communicates with the dehumidified air supply, or it can be a single aperture that has a dimension in the direction of the tunnel substantially equal to the length of the tunnel.

In one preferred embodiment of this alternative, the air inlet means pass through the floor or side wall adjacent to the junction of the floor and one side wall of the tunnel and the outlet means are located adjacent to the junction of the other side wall and the ceiling. This configuration would result in the flow of air between inlet and outlet passing between two opposed corners of the tunnel when considered in cross section if the commodities to be conditioned and the flow influencing or agitating means were not present. Presence of commodity will cause the air to flow round the commodity, and the flow presence of influencing means will cause turbulence in the air flow which has the beneficial effects as described above.

In a further possible embodiment of the present invention, the air input means directs the air into the tunnel from the lower region of the side walls and against a deflector that deflects the air towards the commodities to be conditioned. The deflector may have a surface configuration that will promote the deflected air to be turbulent. The deflector can also act as a heat exchanger, either heating or cooling the air that strikes it.

The air entering the tunnel may either be heated or cooled by heaters/coolers in the region of the air inlets, or by heaters/coolers in the air supply means.

In one embodiment of the present invention a secondary air flow of conditioning air is induced along the length of the tunnel. In this embodiment it is an option to place means for creating turbulence in the secondary longitudinal air flow in the tunnel. Such turbulence inducing means may be flexible, extend substantially into the tunnel, and be resiliently displaced by the passing of a batch of commodities. Alternatively they may be rigidly fixed in the tunnel, but in such a position that they do not interfere with the passing of a batch of commodities. In the preferred embodiment the air flow opposes the direction of movement of the conveyor. A further alternative is a combination of rigid and flexible turbulence induction means.

In operation of the apparatus of the present invention the conveyor may be made to travel at variable speeds depending upon the type of fabric being conditioned. Typically, however, the conveyor speed will be 0.5 m per minute. The apparatus will optionally be so dimensioned that the length of the conveyor in the tunnel will be in the order of 30 m giving a total time for travel through the tunnel of around 45 to 60 minutes. The tunnel may be straight, circular, serpentine or of a "U" shaped arrangement depending on the space available where the apparatus of the present invention is to be installed.

It has been found that for some types of fabric, and especially modern synthetic fabrics, the optimum conditioning of the commodities is achieved if the temperature of the air exiting the air inlets varies along the length of the tunnel in one or both of the first two thirds, or the final third of the tunnel length. Such variation may take the form of increasing the temperature of the air along the length of the tunnel in the direction of travel of the conveyor means. Alternatively, in one method of conditioning the commodities, the air inlets in a first portion of the tunnel direct cooled or cold air onto the commodities, and in a second portion of the tunnel adjoining the first portion, heated or hot air is directed onto the commodities.

The apparatus of the present invention has the versatility that all the above proposed different methods of operation may be accommodated by the apparatus without alteration to the structure of the apparatus. Indeed, the apparatus of the present invention can be switched between different methods of operation whilst operating and conditioning commodities with only a small longitudinal length of the tunnel separating different operating methods. This feature limits the period of time in which the apparatus is not conditioning commodities and helps to maintain a constant high throughput of commodities. A computer may be employed to monitor the position of a particular batch of commodity in the tunnel and adjust the air inlets local to that batch to the optimum conditioning conditions.

The present invention will be further described and explained by way of example with reference to the accompanying drawings in which:

FIG. 1 shows a side view of a portion of one embodiment the apparatus of the present invention, FIG. 2 shows a cross section through the tunnel of one embodiment the apparatus of the present invention, and FIG. 3 shows a cross section through the tunnel of a second embodiment of the apparatus of the present invention.

Referring to FIGS. 1 and 2, a tunnel 2 is made up of a floor 4, a ceiling 6 and two side walls 8. Passing along tunnel 2 adjacent to ceiling 6 is a conveyor mechanism 10. Conveyor mechanism 10 is adapted to support batches of a commodity, such as clothing 12, and support clothing 12 inside the confines of tunnel 2 without clothing 12 interfering with any of walls 4 or 8. Conveyor 10 is so configured as to transport clothing 12 along the tunnel 2 at a speed of approximately 0.5 m per minute.

Located in side walls 8 at regular spacings along the longitudinal length of tunnel 2 are air inlets 14. The air inlets 14 on each of walls 8 are opposed one to the other as may be seen in FIG. 2.

Each of air inlets 14 is equipped with a fan 16 which serves to propel air from a conduit 18 into the tunnel and when batch 12 is between opposing air inlets 14, against the clothing of batch 12. Conduit 18 is located outside of each of side walls 8, and supplies a common air supply to each of air inlets 14.

Located between conduit 18 and fan 16 in each of air inlets 14 is a heating grill 24. Heating grill 24 is a mesh of electrically resistive elements heated so that as the air passes from conduit 18 and into tunnel 2 it is heated. Optionally, a thermostat (not illustrated) may be located on the tunnel side of fan 16 so that the temperature of the air exiting an individual air inlet 14 may be maintained at a predetermined temperature. Alternative methods of warming the air, such as passing it through a heat exchanger could, if desired, be used.

A second conduit 20 is located above the ceiling 6 of tunnel 2 and communicates with the inside of tunnel 2 through air outlets 22 regularly spaced along the longitudinal length of tunnel 2. Preferably air outlets 22 are located at the same positions along the tunnel as the pair of opposing air inlets 14. In an alternative (unillustrated) embodiment air outlets 22 may be spaced longitudinally between the longitudinal positions of air inlets 14.

The air is drawn through outlets 22 into conduit 20 by way of a means, not shown, such as an extractor fan or other similar methods of inducing a lower than atmospheric pressure within conduit 20. The air drawn into conduit 20 is transported to a dehumidifier unit (not shown) and once the air has been dehumidified the air is passed into conduits 18.

Referring to FIG. 3, and using the same numbering as in FIGS. 1 and 2, a tunnel 2 is made up of a floor 4, a ceiling 6 and two side walls 8. Passing along tunnel 2 adjacent to ceiling 6 is a conveyor mechanism 10. Conveyor mechanism 10 is adapted to support batches of a commodity, such as clothing 12, and support clothing 12 inside the confines of tunnel 2 without clothing 12 interfering with any of walls 4 or 8. Conveyor 10 is so configured as to transport clothing 12 along the tunnel 2 at a speed of approximately 0.5 m per minute.

Air inlets 30 pass through floor 4 adjacent the junction of left hand side wall 8 and floor 4 as seen in the drawing. Air outlets 32 pass through right hand side wall 8 adjacent the junction of that wall and ceiling 6. Fans 34 are mounted on side walls 8 and rotated at such a speed that their rotation causes the air flow between the inlet 30 and outlet 32 to become turbulent substantially at the level of the fans 34. This causes turbulent air to buffet and penetrate the clothing 12 and so condition it throughout. In a still further embodiment, air inlets 30 pass through left hand side wall 8 adjacent the junction of that wall and floor 4, and air outlets 32 pass through ceiling 6 adjacent the junction of ceiling 6 and right hand side wall 8.

What is claimed is:

1. Apparatus for the conditioning of a commodity suitable for vacuum packing (12) in which there is provided a conditioning tunnel (2) including a floor (4), a ceiling (6)

and first and second side walls (8) through which tunnel (2) runs a conveyor system (10) adjacent the ceiling (6) of the tunnel (2) for transporting the commodity therethrough suspended therefrom, air inlets (14) for directing streams of air into the tunnel (2), air outlet means (22) through which air may be extracted from the tunnel (2), means for conveying air from the outlet means (22) to apparatus for dehumidifying the air and means (16) for conveying the dehumidified air to the air inlets (14), characterised by at least one means (16) on the side walls (8) of the tunnel (2) influencing the flow path of the air passing from the air inlets (14) to the air outlet means (22) to provide a turbulent airstream which subjects the suspended commodity (12) to multidirectional buffeting and causes the dehumidified air to penetrate the commodity (12) so that the commodity may be more evenly and completely conditioned.

2. Apparatus according to claim 1 in which the air inlets pass through both side walls (8) of the tunnel, one or more of the air inlet means is provided with an air temperature regulation means (24) to regulate the temperature of the input air, and the air extraction means are located in the ceiling of the tunnel.

3. Apparatus according to claim 2 in which a plurality of air temperature regulation means provided at a plurality of air inlets are independently controlled.

4. Apparatus according to claim 1 in which the means for influencing the flow path for the air passing from the inlet to the outlet is located in the mouth of the air inlet means.

5. Apparatus according to claim 1 in which air inlet means are located at the same longitudinal position along the tunnel in each side wall.

6. Apparatus according to claim 1 in which each air inlet is provided with a fan (16) impelling air into the tunnel.

7. Apparatus according to claim 1 in which air is impelled into the tunnel through each air inlet by a single air impelling means which impels the air to and out of each air inlet (14).

8. Apparatus according to claim 1 in which one or more of the air inlets is provided with means for directing the flow of air entering the tunnel.

9. Apparatus according to claim 1 in which the air inlet means (30) pass through the floor of the tunnel.

10. Apparatus according to claim 9 in which the air inlet means are a plurality of apertures (30) through the floor spaced along the length of the tunnel.

11. Apparatus according to claim 9 in which the air inlet means is a single aperture through the floor of the tunnel, the inlet means being dimensioned so as to extend substantially for the length of the tunnel.

12. Apparatus according to claim 9 in which the air inlet means (30) passes through the floor (4) adjacent to an edge of the floor that abuts a first side wall (8), and the air outlet means (32) is located in the region there the second side wall (8) abuts the ceiling (16).

13. Apparatus according to claim 1 in which the air inlet means are located in and at the base of at least one of the side walls (8).

14. Apparatus according to claim 13 in which the floor includes or has mounted on it air deflection means, the air inlet means directs the air against the deflection means, and the deflection means redirects the air towards the commodity.

15. Apparatus according to claim 14 in which the surface of the air deflection means is configured so as to cause turbulence in the air deflected towards the commodity.

16. Apparatus according to claim 1 to 15 in which at least one of the means for influencing the flow path of the air is a fan (16, 34).

17. Apparatus according to claim 1 in which a second air stream is directed along the length of the tunnel.

18. Apparatus according to claim 17 in which the direction of the second air stream is opposed to the direction of travel of the conveyer system.

* * * * *